US008955590B2

(12) United States Patent
Salvador

(10) Patent No.: US 8,955,590 B2
(45) Date of Patent: Feb. 17, 2015

(54) OVERSHOT DEVICE

(75) Inventor: Patrick Salvador, North Bay (CA)

(73) Assignee: Atlas Copco Canada Inc., Dollard-des-Ormeaux (CA)

( * ) Notice: Subject to any disclaimer, the term of this patent is extended or adjusted under 35 U.S.C. 154(b) by 564 days.

(21) Appl. No.: 13/379,233

(22) PCT Filed: Jun. 10, 2010

(86) PCT No.: PCT/EP2010/058134

§ 371 (c)(1),
(2), (4) Date: Feb. 8, 2012

(87) PCT Pub. No.: WO2010/145984

PCT Pub. Date: Dec. 23, 2010

(65) Prior Publication Data

US 2012/0125612 A1 May 24, 2012

(30) Foreign Application Priority Data

Jun. 18, 2009 (EP) ..... 09007965

(51) Int. Cl.
*E21B 31/18* (2006.01)
*E21B 31/12* (2006.01)

(52) U.S. Cl.
CPC ..... *E21B 31/18* (2013.01); *E21B 31/12* (2013.01)
USPC ..... 166/301; 166/99

(58) Field of Classification Search
CPC ..... E21B 31/12; E21B 31/18
USPC ..... 166/301, 99, 242.6; 294/86.27
See application file for complete search history.

(56) References Cited

U.S. PATENT DOCUMENTS 1,537,619 A 5/1925 Puckett
1,571,332 A 2/1926 Herminghausen
1,719,144 A * 7/1929 Stokes et al. ..... 294/86.2

(Continued)

FOREIGN PATENT DOCUMENTS

CN 87 2 01266 U 3/1988
RU 2 029 051 C1 2/1995

(Continued)

OTHER PUBLICATIONS

PCT/ISA/210—International Search Report—Feb. 16, 2011.

(Continued)

*Primary Examiner* — Cathleen Hutchins
(74) *Attorney, Agent, or Firm* — Venable LLP; Eric J. Franklin

(57) ABSTRACT

A device with an overshot including a first part with an elongated body adapted to be connected to a hoisting line in one end and with a tubular opening arranged/designed to receive a spearhead in the other end. The overshot further includes a second part with a scissor like mechanism including two lifting dogs arranged to pivot around a common pivot pin. The lifting dogs are connected via a biasing unit and the elongated body includes a central, axially extending slot. The scissor like mechanism is arranged with the common pivot pin sliding in the slot between a first end position where the biasing unit is arranged to close the lifting dogs such that a spearhead received in the tubular opening is locked and a second end position where an opener including an opening pin is arranged to force the lifting dogs open against the force of the biasing unit, such that a spearhead received in the tubular opening is released.

11 Claims, 14 Drawing Sheets

(56) References Cited

U.S. PATENT DOCUMENTS

| | | | | |
|---|---|---|---|---|
| 2,296,397 | A | 9/1942 | Muhlbach | |
| 3,930,679 | A | 1/1976 | Anderson et al. | |
| 4,004,835 | A | 1/1977 | Taylor | |
| 4,515,403 | A | 5/1985 | Cheek | |
| 6,564,885 | B2 * | 5/2003 | Attwater | 175/235 |
| 6,997,493 | B2 | 2/2006 | Beach | |
| 2007/0046051 | A1 | 3/2007 | Streater et al. | |

FOREIGN PATENT DOCUMENTS

| | | | |
|---|---|---|---|
| RU | 2 304 692 | C2 | 8/2007 |
| SU | 16 135 76 | A1 | 12/1990 |
| WO | WO-2007/041778 | A1 | 4/2007 |

OTHER PUBLICATIONS

PCT/ISA/237—Written Opinion of the International Searching Authority—Feb. 16, 2011.

PCTIPEA/409—International Preliminary Report on Patentability—Sep. 13, 2011.

Decision on Grant issued by Russian patent office May 6, 2014, in counterpart application 2012101638/03(002205) with English-language Translation.

US 5,592,944, 1/1997, Laporte et al. (withdrawn)

* cited by examiner

OVERSHOT DEVICE

TECHNICAL FIELD

The present invention relates to a device comprising an overshot for handling the core barrel after each drilling cycle, for example.

BACKGROUND ART

During diamond drilling for geotechnical application or mining exploration, an inner-tube is filled up with rock core. When the inner-tube is full, the operator needs to recover it. The inner-tube is linked with a head assembly or back end that permits to recover the inner-tube. An overshot is used like a fishing system to grab the head assembly. The overshot is in turn linked with a steel wire comprised in a wire line hoist system.

When an overshot and an inner tube are pulled out of a rod string for core recovery, there is a possibility that the overshot releases the spear head assembly by accident. If this happens, there is risk for workers injury and damage to the equipment.

The document U.S. Pat. No. 6,997,493 teaches a lockable overshot comprising an elongated body, lifting dogs and a locking sleeve. The ends of the lifting dogs are configured for latching a conventional spearhead point there between.

A locking sleeve is rotatable on the body between a locked state preventing ends of the lifting dogs from pivoting away from other to release a previously latched spearhead point, and an unlocked state where the locking sleeve allows the lifting dogs to move so that the ends can be pivoted away from each other to release a previously latched spearhead point. When the overshot goes out of the rod string, the operators have to stop, to lock, retrieve, unlock manually by rotating the locking sleeve into the unlocked position and manually pivot the two lifting dogs to separate the overshot from the spearhead assembly and get the core sample out. This is time consuming. Further, there is possibility operators choose not to lock the overshot at all. The operation can be difficult if dirt is present in the mechanism. At that time there is a risk for accident. The overshot also has the possibility to accidentally release the spearhead while still in the drill string, dropping the inner tube assembly to the bottom of the hole, causing damage to equipment.

The document U.S. Pat. No. 4,004,835 teaches an overshot comprising a tubular sleeve and a scissor like mechanism arranged moving as a unit. A spring bearing on the top end of the scissors tends to force them down into closing movement against an inner taper of the bottom ring of the tubular sleeve. The solution permits downward movement which releases the fishing neck. This avoids placing undue strain on the overshot.

Thus, there are needs to increase the safety and efficiency when working with an overshot. These needs cannot be fulfilled by overshot according to the above-mentioned prior art.

SUMMARY OF THE INVENTION

An object of the invention is to increase the safety when working with overshot. The problem to be solved is to increase the control of the release operation of a caught spearhead.

According to a first aspect of the present invention, the invention provides an overshot comprising a first part with an elongated body adapted to be connected to a hoisting line in one end and with a tubular opening arranged/designed to receive a spearhead in the other end. The overshot further comprises a second part with a scissor like mechanism comprising two lifting dogs arranged to pivot around a common pivot pin and arranged connected with a biasing means. The elongated body comprises a central, axially extending slot and the scissor like mechanism is arranged with the common pivot pin sliding in the slot between a first end position where the biasing means is arranged to close the lifting dogs and thereby lock a spearhead received in the tubular opening and a second end position where opening means is arranged to force the lifting dogs open to release a spearhead received in the tubular opening.

The solution according to the invention provides an overshot where the risk of accidental release of a head assembly is eliminated.

The solution may also be adapted with pump-in seals to be used in an underground application.

Further, the solution according to the invention provides a safe and secure way of operating an overshot. The solution lends the operator full control of locking and releasing an overshot.

The feature up/upwards is defined as a direction axially along the overshot towards the hoisting line connection i.e. up in FIG. 2-4. The feature down/downwards is defined as a direction axially along the overshot towards the head assembly i.e. same as force of gravity and down in FIG. 2-4.

The biasing means is defined arranged to pivot the lifting dogs to a closed position, where the lifting dogs are in a gripping position due to its spring force.

The opening means is defined arranged to force the lifting dogs to pivot to an open position, where the lifting dogs are separated in a non-gripping position due to a manual force overcoming the spring force of the biasing means.

The feature "biasing means" is defined as a spring means comprising a tension spring, a compression spring or any other suitable spring.

The force exerted by the biasing means will be translated onto the pivot pin causing the lifting dogs to move downwards to the bottom position, away from the hoist line end of the overshot so that the lifting portion of the lifting dogs are locked within the inside features of the overshot head. At the same time, the force of gravity acting on the scissor like mechanism combines to the movement.

According to a feature of the invention, the biasing means comprises a tension spring arranged connecting the lever portions of the lifting dogs.

According to a feature of the invention, the biasing means comprises a compression spring arranged connecting the lever portions of the lifting dogs.

According to a feature of the invention, the opening means are arranged stationary attached to the elongated body. According to a feature of the invention, the opening means comprises an opening pin arranged stationary in the elongated body. The opening pin is arranged between the lifting dogs and protruding from the elongated body surface. According to one alternative, the stationary opening pin is positioned axially above the slot, between the slot and the hoisting line connection end.

According to another alternative, the stationary opening pin is positioned axially below the slot, between the slot and the tubular opening end.

According to a feature of the invention, the opening pin is a sliding pin arranged sliding in the slot and connected to the pivot pin by a sliding bar.

According to a feature of the invention, the sliding pin is arranged in parallel with the pivot pin.

According to a second aspect of the present invention, the invention provides a method of operating an overshot comprising a first part with an elongated body connected to a hoisting line in one end and with a tubular opening arranged/designed to receive a spearhead in the other end. The overshot further comprises a second part with a scissor like mechanism comprising two lifting dogs and a common pivot pin, where the lifting dogs are connected via a biasing means. The elongated body comprises a central, axially extending slot and the scissor like mechanism is arranged with the common pivot pin sliding in the slot. The method comprising manually operating the common pivot pin to slide in the slot from a first end position, where the biasing means is arranged to pivot the lifting dogs to grip a spearhead received in the tubular opening to a second end position, and forcing the lifting dogs to pivot into a non-gripping position due to the sliding movement such that the spearhead is released when the pivot pin reaches the second position.

Manually holding the lifting dogs against the opening means in the up/top position will force the lifting dogs open and thus allowing the release of the spearhead. To release the inner-tube from the overshot at the surface, the operator has to push the spear head inside the overshot and maintain the sliding bar in the up/top position. Alternatively, the tension of the lifting dogs is released on the spearhead to start with and then the operator has to push the sliding bar and maintain up a pin and continue the movement/pushing of the sliding bar to up/top position. This is safe, easy and quickly done and improves the productivity.

The overshot according to the invention is a mechanism for latching onto a spearhead that greatly reduces the chances of accidental release of the spearhead. The forced pivoting of the lifting dogs into a non-gripping position is a secure and controllable operation of a spearhead. This in turn guarantees the secure operation of the overshot and assures the workers safety.

According to a third aspect of the invention, the invention provides an use of an overshot as described above in an underground application in conjunction with an underground adapter with a propulsion seal to propel the overshot through the drill string (not shown) using fluid under pressure.

The invention is considered to comprise alternative features with at least one secondary pin placed in the overshot head to prevent the lifting dogs from rotating out of the side openings of the overshot head. This pin can be located either above or below the main pivot pin.

This pin can also be used to slide against the lifting dogs to force them closed when moved to the bottom position or open when moved to the top position.

The secondary pin can also be joined to the main pivot pin by an external sliding bar, so that it moves in conjunction with the main pivot and to stop the lifting dogs from pivoting out of the side openings of the overshot head.

BRIEF DESCRIPTION OF THE DRAWING

The invention will be explained more closely by the description of different embodiments thereof and with reference to the appended drawing in which.

DESCRIPTION OF ALTERNATIVE EMBODIMENTS

Figure 1:
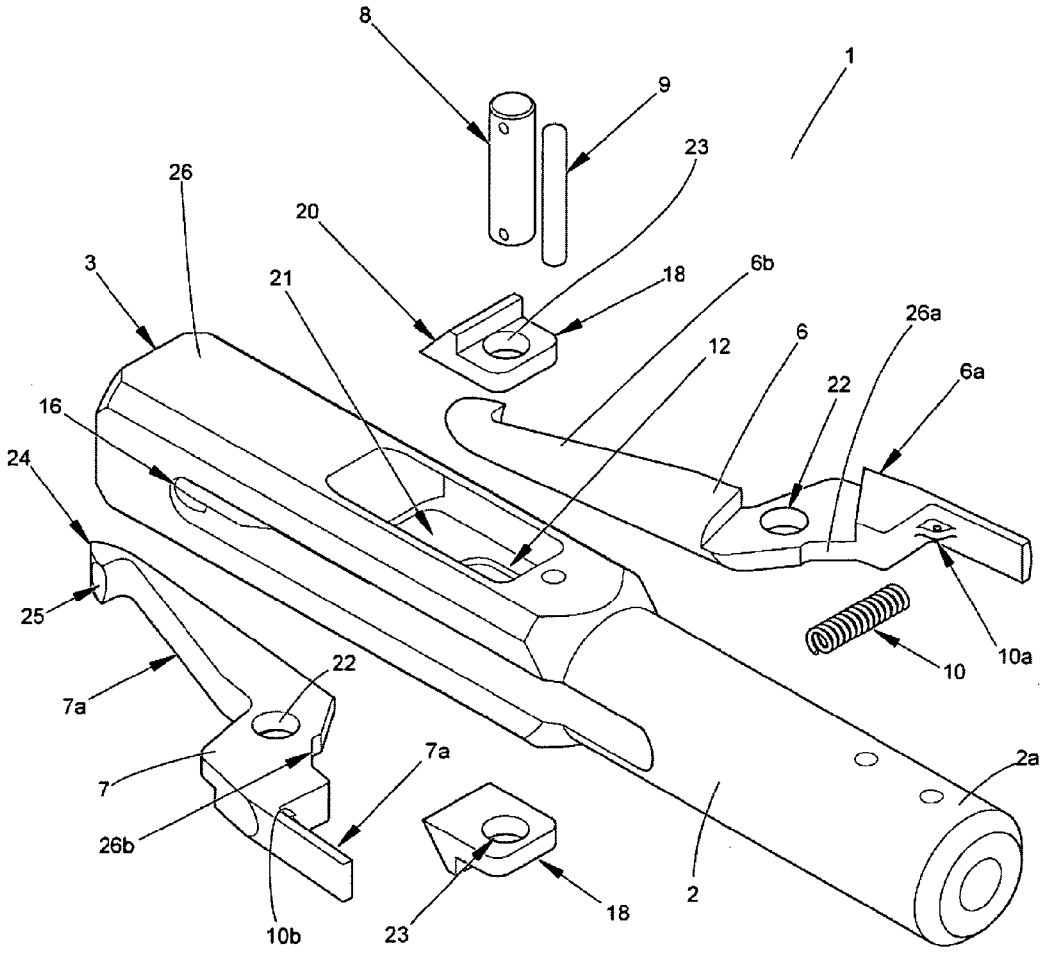
FIG. 1 is an exploded view of an overshot arrangement according to the invention.

FIG. 1 is an exploded view of an arrangement according to the invention comprising an overshot 1 to be used like a fishing system to grab a head assembly. This will be described in detail below.

Figure 2:
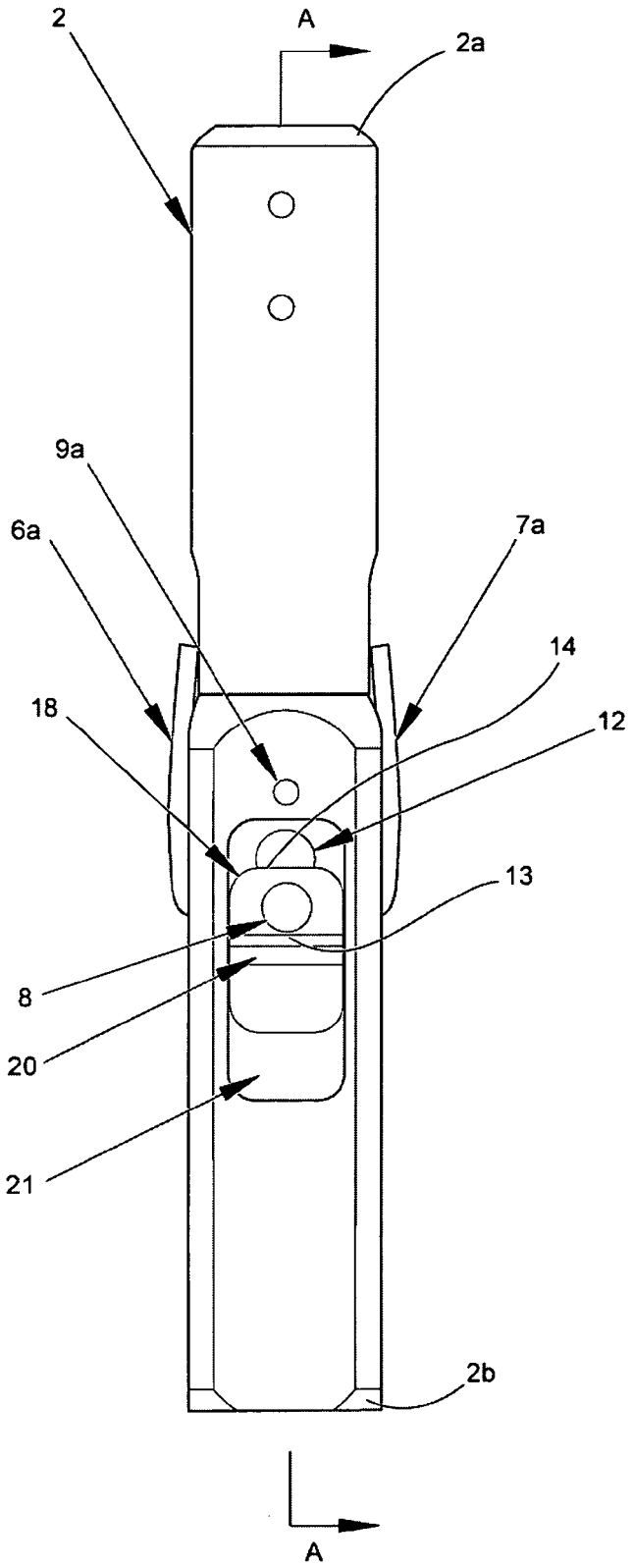
FIG. 2 is an overshot arrangement according to the invention in a closed position.
Figure 3:
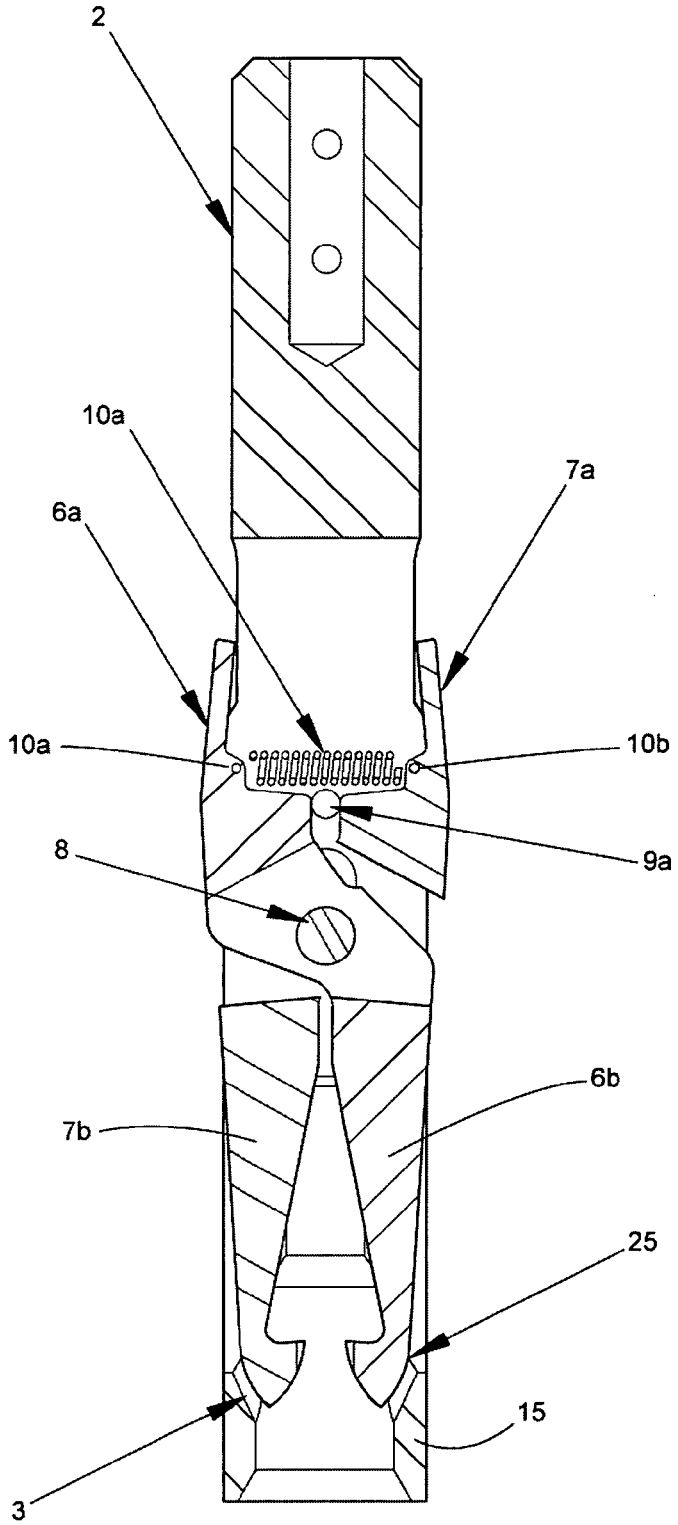
FIG. 3 is a cross section of the overshot arrangement in FIG. 2.
Figure 7:
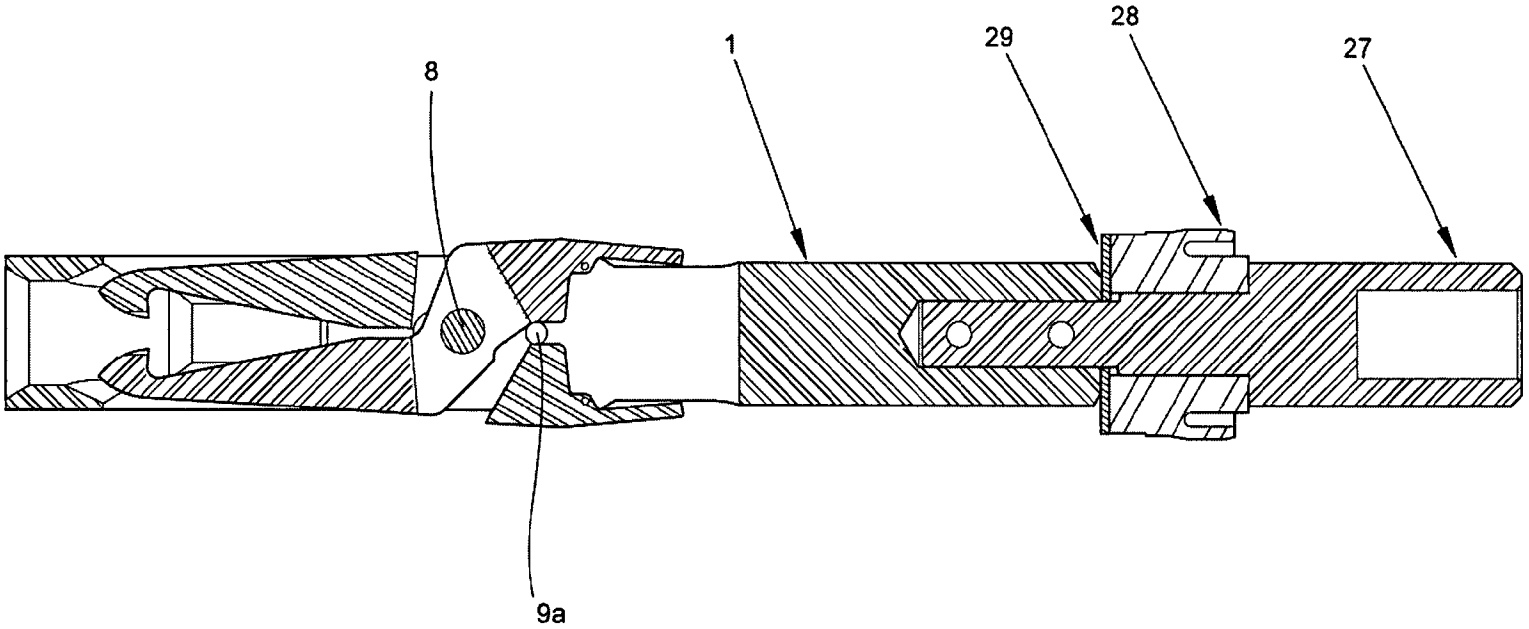
FIG. 7 is a cross section of an overshot arrangement with an underground adapter and propulsion seal according to the invention.

The overshot 1 (FIG. 2) comprises a first part with an elongated body 2 adapted to be connected to a hoisting line in one end 2*a* and with an axial tubular opening in the other end 2*b* arranged to receive a spearhead 4 (FIG. 7). The overshot 1 further comprises a second part with a scissor like mechanism 5 comprising two lifting dogs 6, 7 each comprising a circular opening 22. A pivot pin 8 is arranged through the openings 22 such that the lifting dogs are arranged to pivot around the common pivot pin 8 (FIG. 3). Each lifting dog 6, 7 comprise a lever portion 6*a*, 7*a* and a lifting portion 6*b*, 7*b*. The lever portions 6*a*, 7*a* are connected with a biasing means 10 in the form of a tension spring 10*a* attached between connection points 10*a*, 10*b*.

Figure 4:
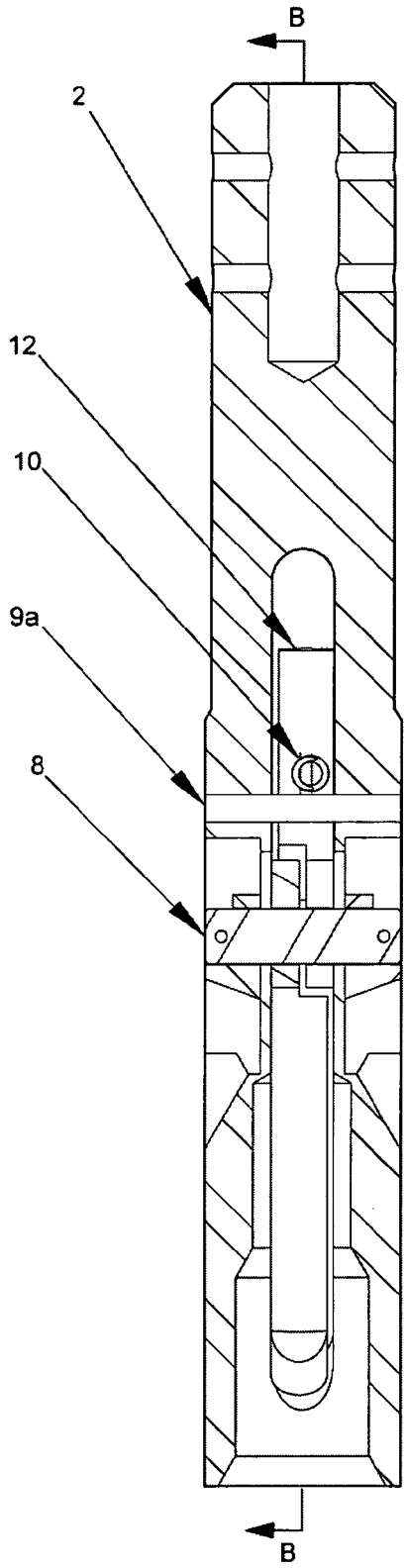
FIG. 4 is a cross section of the overshot arrangement in FIG. 2.

The elongated body 2 comprises a central, axially extending slot 12 and the scissor like mechanism 5 is arranged with the common pivot pin 8 sliding in the slot 12 (FIG. 4). The scissor like mechanism 5 is arranged to move during operation such that the common pivot pin 8 is sliding in the slot 12 between a first end position 13 and a second end position 14 (FIG. 2).

An area 21 around the slot 12 in the overshot body 2 (FIG. 1) for the pivot pin 8 is machined to allow retaining bar or washer to slide with the pivot pin. This area is also machined big enough to allow clearance for the operator to easily hold the pivot pin and a control lever 18 in the top, open position to allow the release of the spearhead 4.

Figure 5:
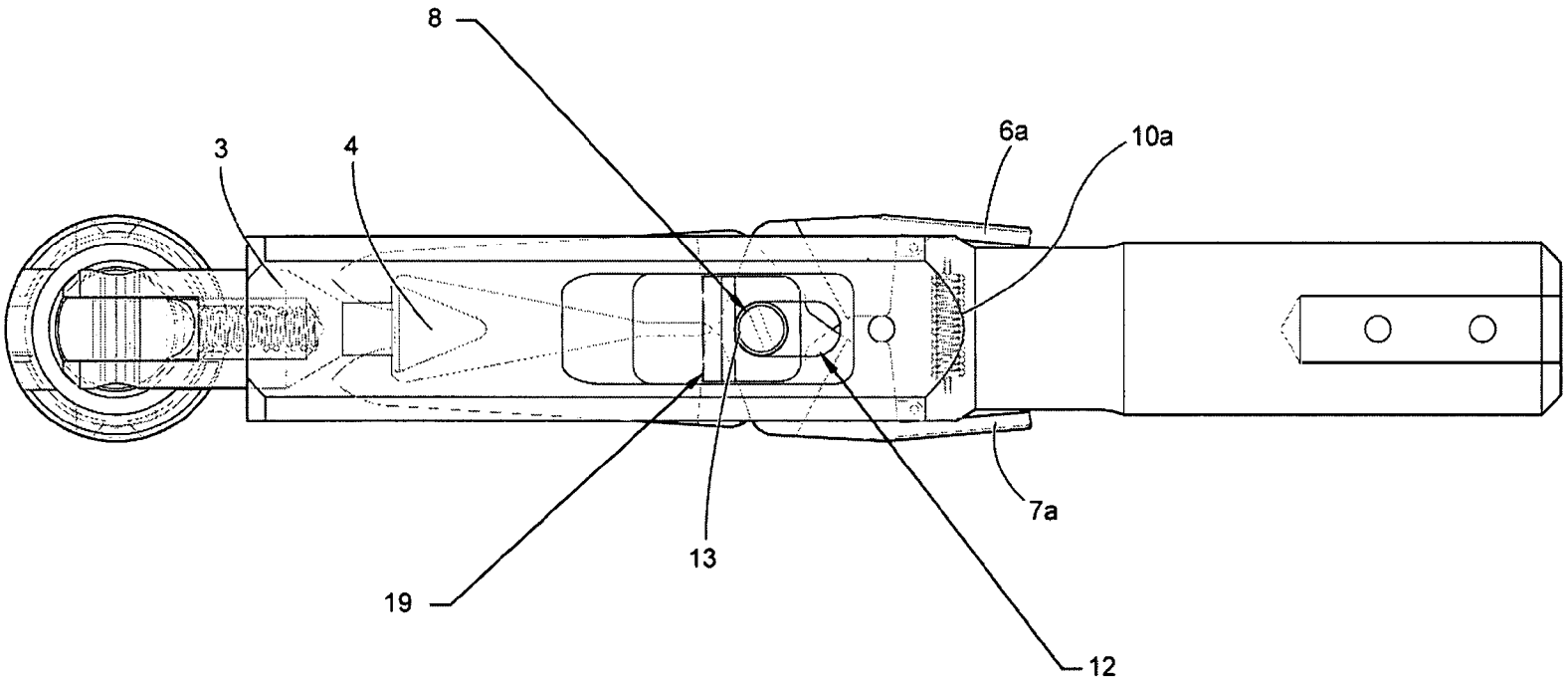
FIG. 5 is a cross section of an overshot arrangement according to the invention in a closed position gripping a head assembly.

The pivot pin 8 slides within the elongated body 2. In the first end position 13 (FIG. 5), the common pivot pin 8 is in its lowermost position in the slot 12. The scissor like mechanism 5 is locked gripping a spear head 4 received in the tubular opening 3 due to the tension spring 10*a* forcing the lever portions 6*a*, 7*a* to close. In this first end position 13, the lifting portions 6*b*, 7*b* are mechanically contained within the body 2, prevented from opening and releasing the spearhead 4.

The lifting portions 6*b*, 7*b* of the lifting dogs are designed to grab onto the spear head. To limit the movement of the lifting dogs, the locking features 15 of the head were designed to contain the lifting portion of the lifting dogs within the interior of the head throughout the travel of the lifting dogs.

Figure 6A:
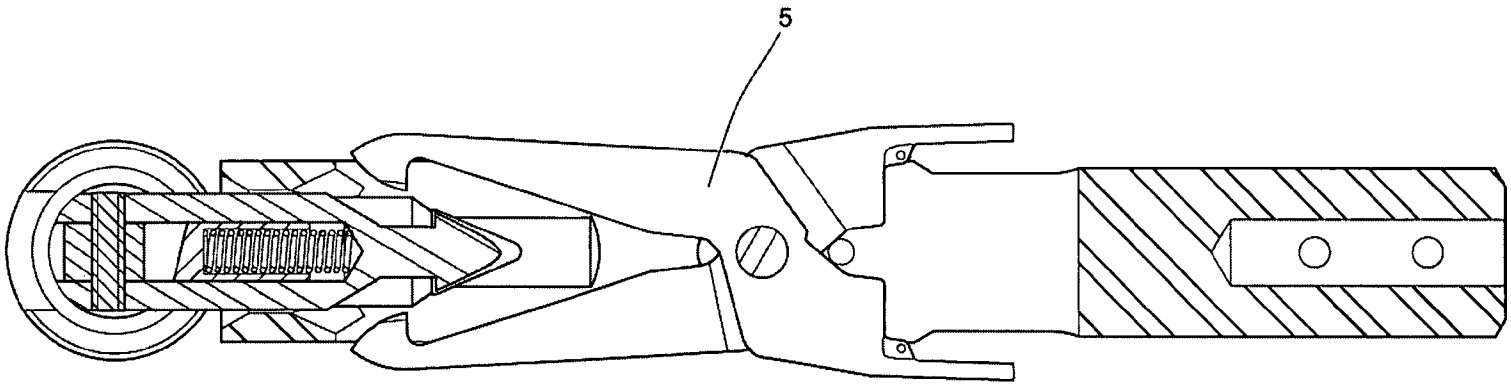
FIG. 6*a* is a schematic view of an overshot arrangement according to the invention in a position of releasing a head assembly.

Manually holding the scissor like mechanism 5 against the opening means 9 in the up/top position will force the lifting dogs 6, 7 open and thus allowing the release of the spearhead 4. To release the inner-tube from the overshot at the surface, the operator has to push the spear head inside the overshot and maintain the sliding bar in the up/top position. Alternatively, the tension of the lifting dogs is released on the spearhead to start with and then the operator has to push the sliding bar and maintain up a pin and continue the movement/pushing of the sliding bar 18 to up/top position. This is safe, easy and quickly done and improves the FIG. 6*a* is a cross section of an overshot arrangement according to the invention in a position between first 13 and second end positions 14 on the way of releasing the head assembly.

Figure 6B:
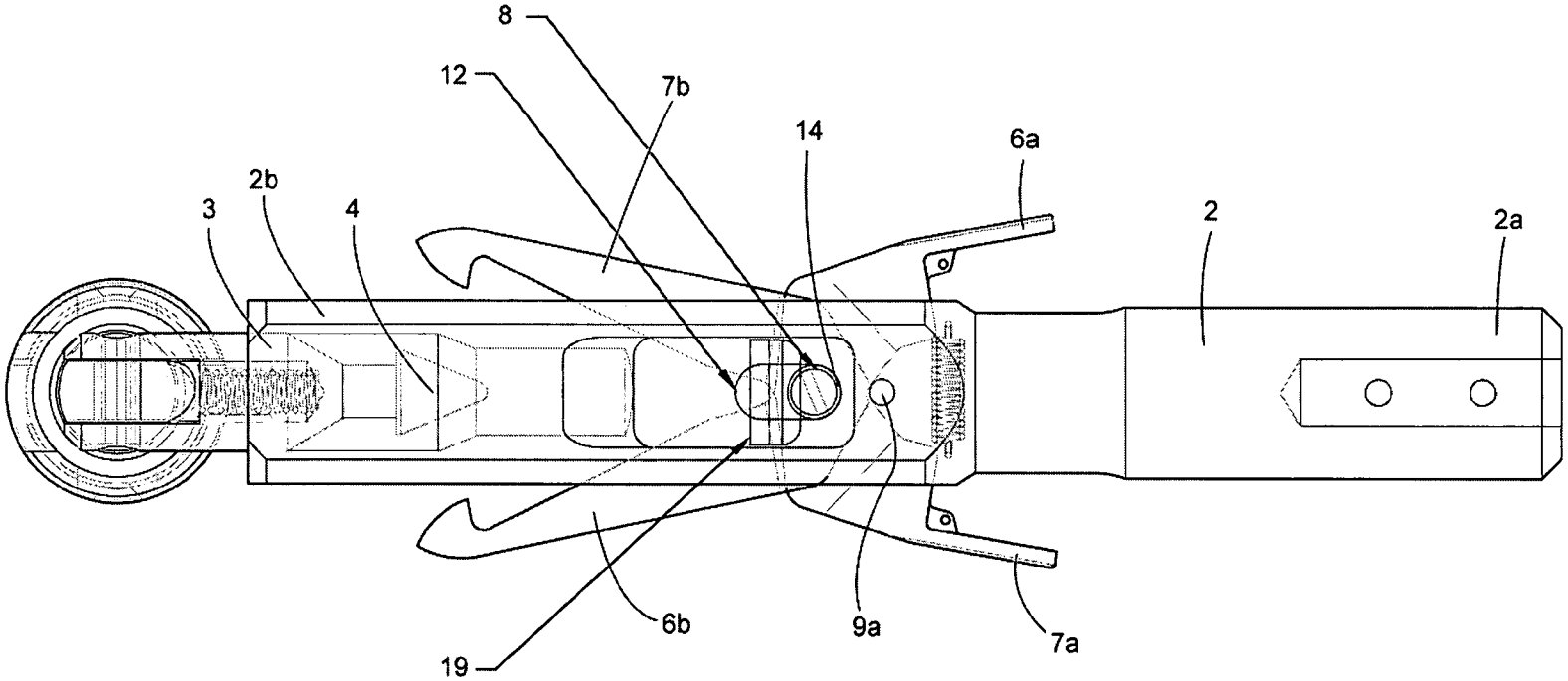
FIG. 6*b* is a cross section of an overshot arrangement according to the invention in a position of releasing a head assembly.

In the second position 14 (FIG. 6*b*), the common pivot pin 8 is in its uppermost position in the slot 12. The elongated body 2 is arranged to comprise an opening means 9 arranged to force the two lever portions 6*a*, 7*a* away from each other in the second position 14. The opening means 9 is a pin 9*a* arranged stationary attached to the elongated body 2. The pin 9*a* is arranged in parallel with the common pivoting pin 8 (FIG. 4).

The elongated body 1 further comprises a pair of elongated adjacent and parallel side openings 16, 17 arranged such that the lifting portions 6*b*, 7*b* can pass/exit the inside walls during pivoting of the lifting dogs 6, 7 to an open position.

Each lifting dog 6, 7 comprise a sliding surface curvature 26*a*, 26*b* which is arranged to follow/slide along the stationary opening pin 9*a* during the pivoting/pushing (FIG. 6*a*, 6*b*) to an open position. Thus, the scissor like mechanism 5 is open due to the forced pivoting of the lever portions 6*a*, 7*a* apart into the second position 14. Consequently, a spear head 4 received in the coaxial tubular opening 3 of the overshot is released when the pivot pin 8 is in the second position 14.

When the force is removed from the control lever 18, the force of the spring 10*a* will pull the lifting dog lever portions 6*a*, 7*a* together and close the scissor like mechanism 5, which will move downwards partly due to the sliding surface curvatures 26*a*, 26*b* leaving the sliding contact with the pivot pin 8 and partly due to forces of gravity.

In each of the overshot arrangements in FIG. 1-4, at least one control lever 18 comprising a circular opening 23 and a flat surface 20 is connected to/arranged on the pivot pin 8 for the manual operation of the overshot. The flat surface 20 is adapted to be the surface to touch during pushing.

The pin used as a pivot point for the lifting dogs are secured to the assembly using cotter pins and/or retaining rings at both end to facilitate ease of assemble and reduction of tools and parts.

The slot has been designed into the overshot head to allow the pivot pin to move approximately ⅜"-½". This movement allows the lifting dogs to move in and out of the locked position and interact with the slide pin as mentioned above.

FIG. 7 is an arrangement with an overshot 1. The overshot 1 is connected to an underground adapter 27 comprising a propulsion seal 28 and support washer 29.

Figure 8:
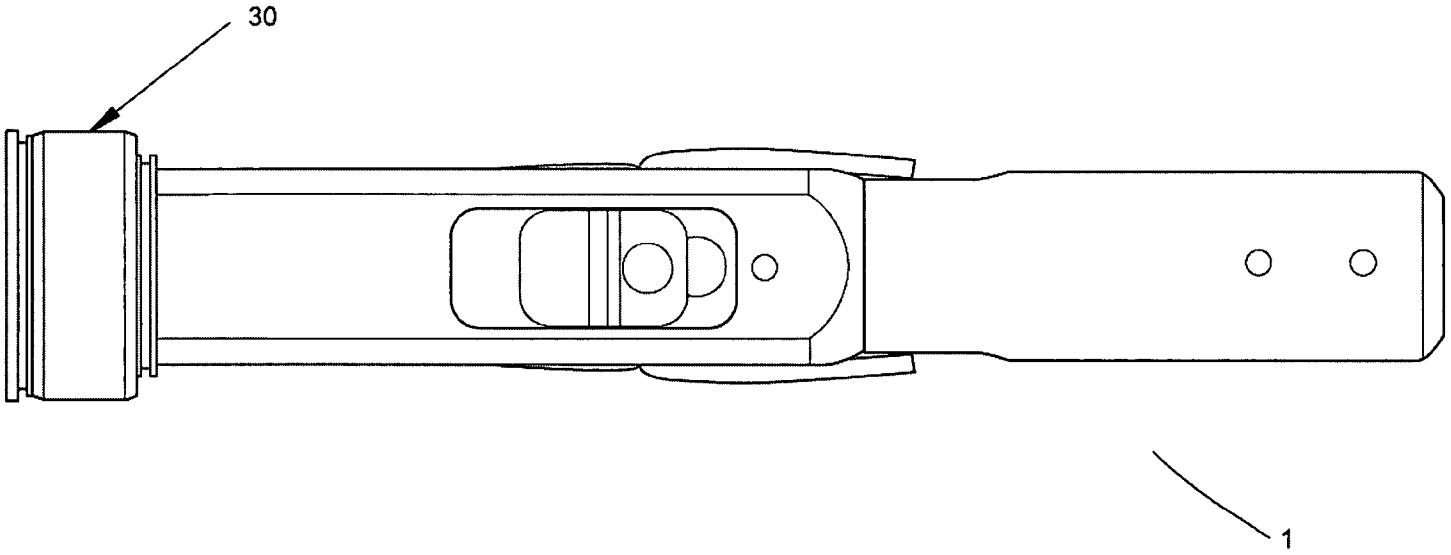
FIG. 8 is an overshot arrangement according to the invention with a pump-in seal.

FIG. 8 is an overshot 1 according to the invention adapted with pump-in seals 30 to be used in an underground application.

Figure 9:
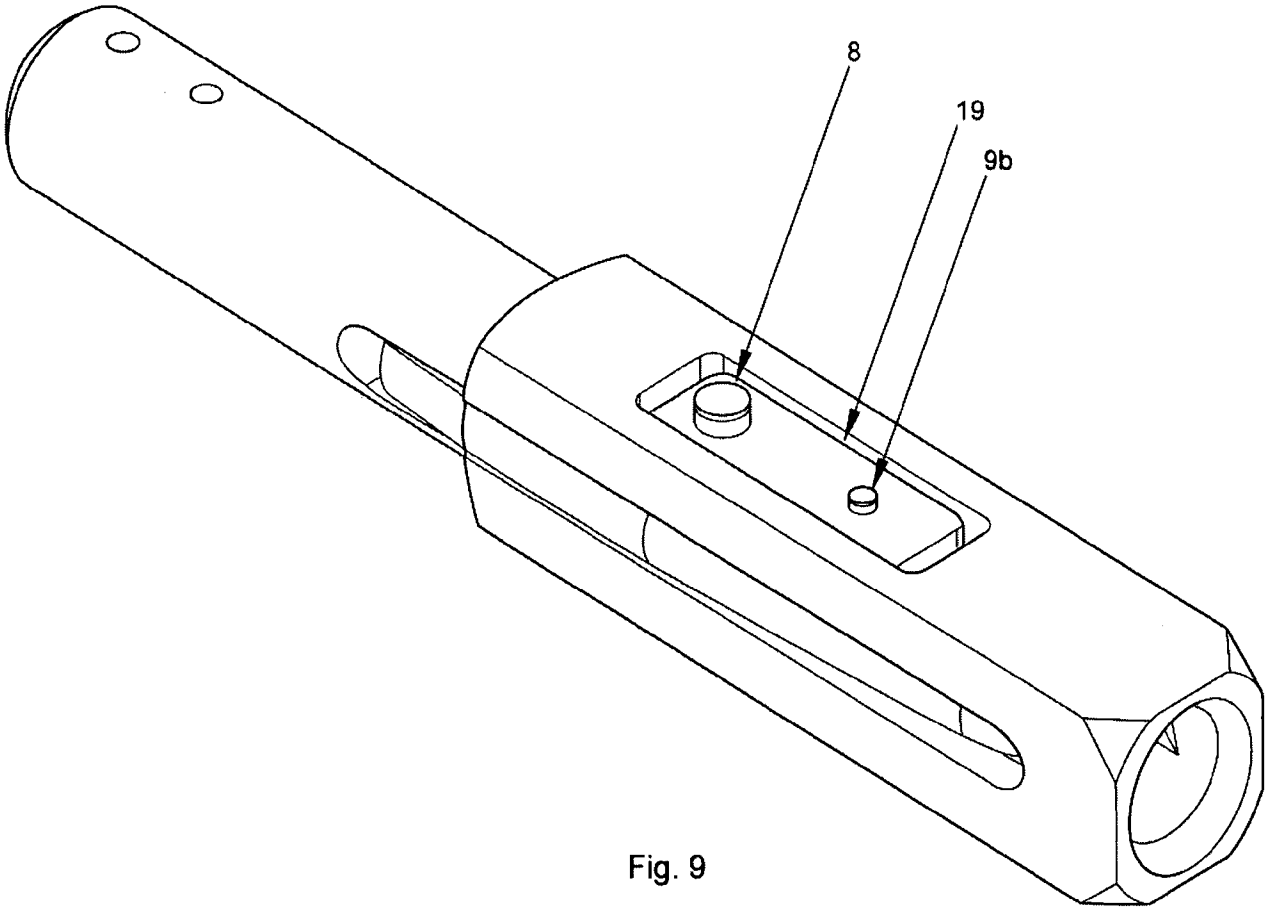
FIG. 9 is an alternative overshot arrangement according to the invention.

FIG. 9 is an overshot 2 wherein the opening means 9 is a sliding opening pin 9*b* arranged sliding in the slot 12 and connected to the pivot pin by a sliding bar 19.

Figure 10:
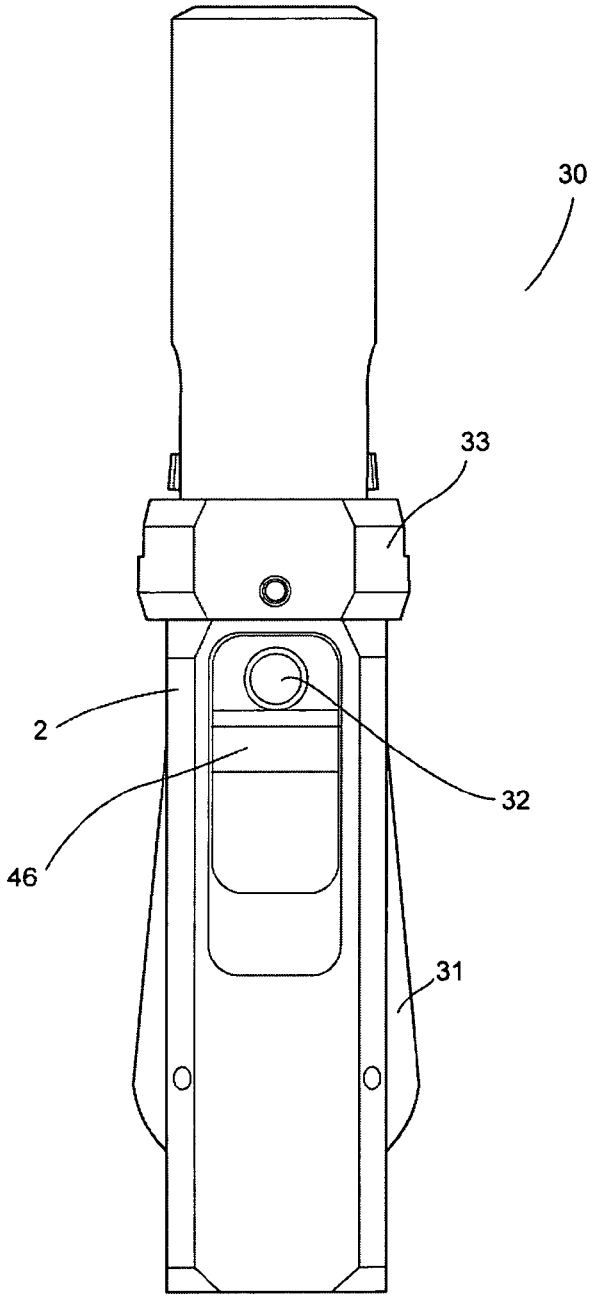
FIG. 10 is an alternative overshot according to the invention in an open position.

FIG. 10 is a device comprising an alternative overshot device 30 comprising a first part with an elongated body 2 and a second part with a scissor like mechanism 31 comprising a pivot pin 32. A protective ring 33 is arranged locking the overshot device 30 to help prevent the lever portion of the lifting dogs from accidentally being forced inwards. In FIG. 10, the scissor like mechanism 31 is in the open position.

The principle of operation of the alternative overshot 30 in FIG. 10 is adapted tom operate in the same way as the one described above.

The overshot device 30 comprises a first lifting dog 34 (FIG. 11*a-c*) comprising a lever portion 34*a* and a lifting portion 34*b*. The lever portion 34*a* in turn comprises a scissor portion 34*c* and a connection point 36 to retain a compression spring. Further, the lever portion comprises an opening 38 arranged to receive the pivot pin 32.

Figure 11A:
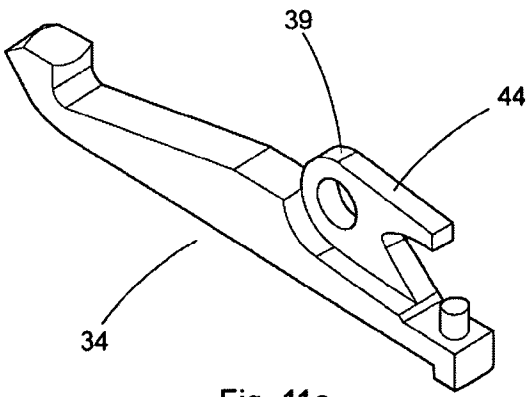
FIG. 11*a-c* is a lifting dog comprised in the overshot in FIG. 10.
Figure 11C:
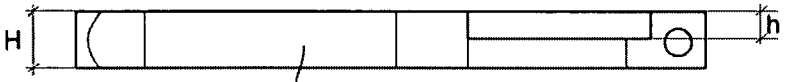

The lifting dog 34 has a part 39 of less thickness than the rest of the lifting dog (FIG. 11*a*). The thickness H of the lifting (FIG. 11*c*) is twice the thickness of the lifting dog part 39, comprising the opening 38. This provides the scissor like mechanism 31.

Figure 12:
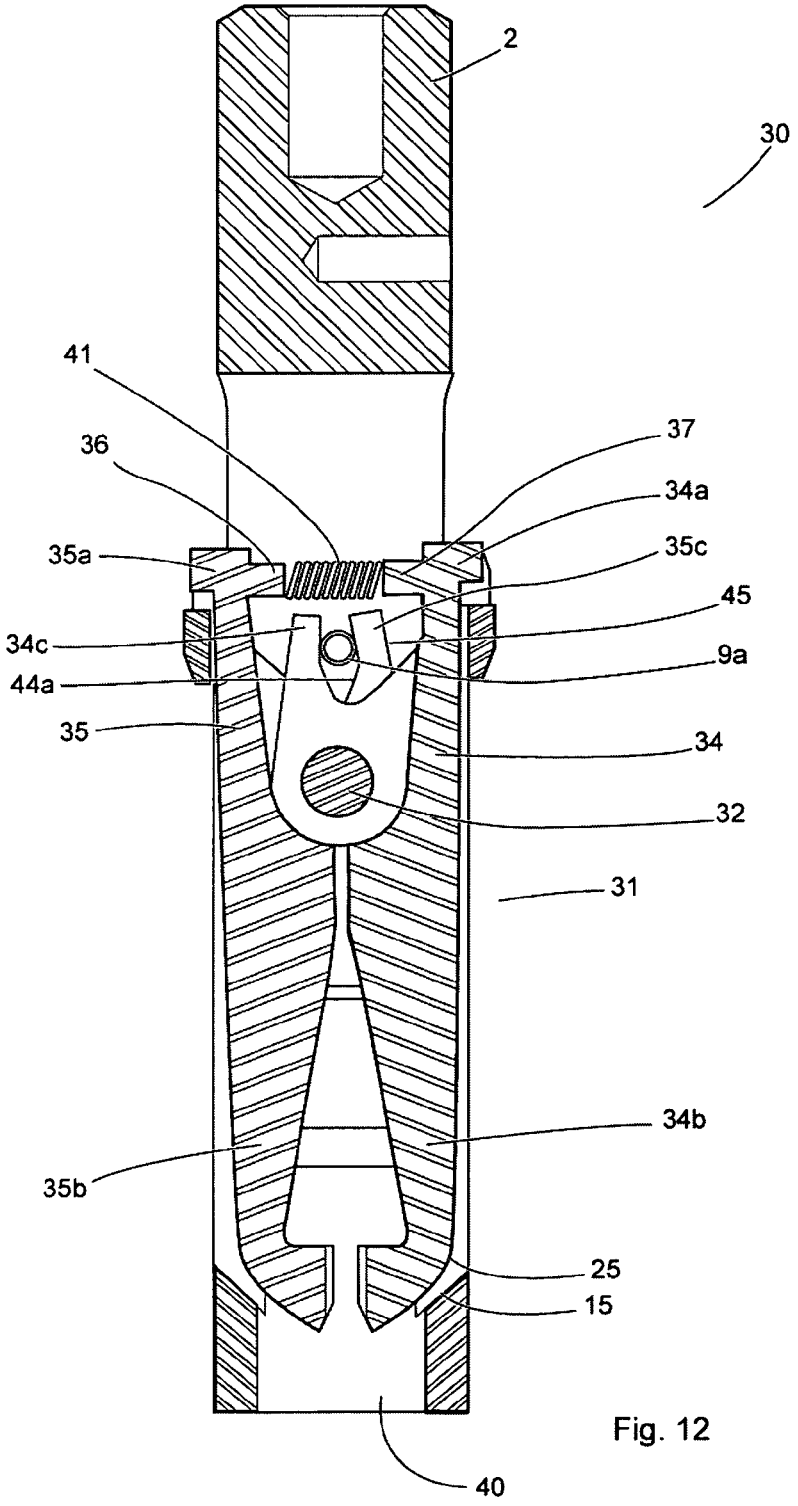
FIG. 12 is a cross section of the overshot in FIG. 10 in a closed locking position.

FIG. 12 is a cross section of an overshot arrangement according to the invention, in a first (closed) position as described above. A first lifting dog 34 and a second lifting dog 35 are arranged pivoting around the common pivot pin 32. The pivot pin 32 slides within the elongated body 2, as described above. In a first end position (FIG. 12), the common pivot pin 32 is in its lowermost position in the slot, as described above. The scissor like mechanism 31 is locked gripping a spear head (not shown) received in the tubular opening 40 due to the spring means 41 forcing the lifting portions 34*b*, 35*b* to close. In this closed position, the lifting portions 34*b*, 35*b* are mechanically contained within the body 2, prevented from opening and releasing a spearhead.

Figure 13:
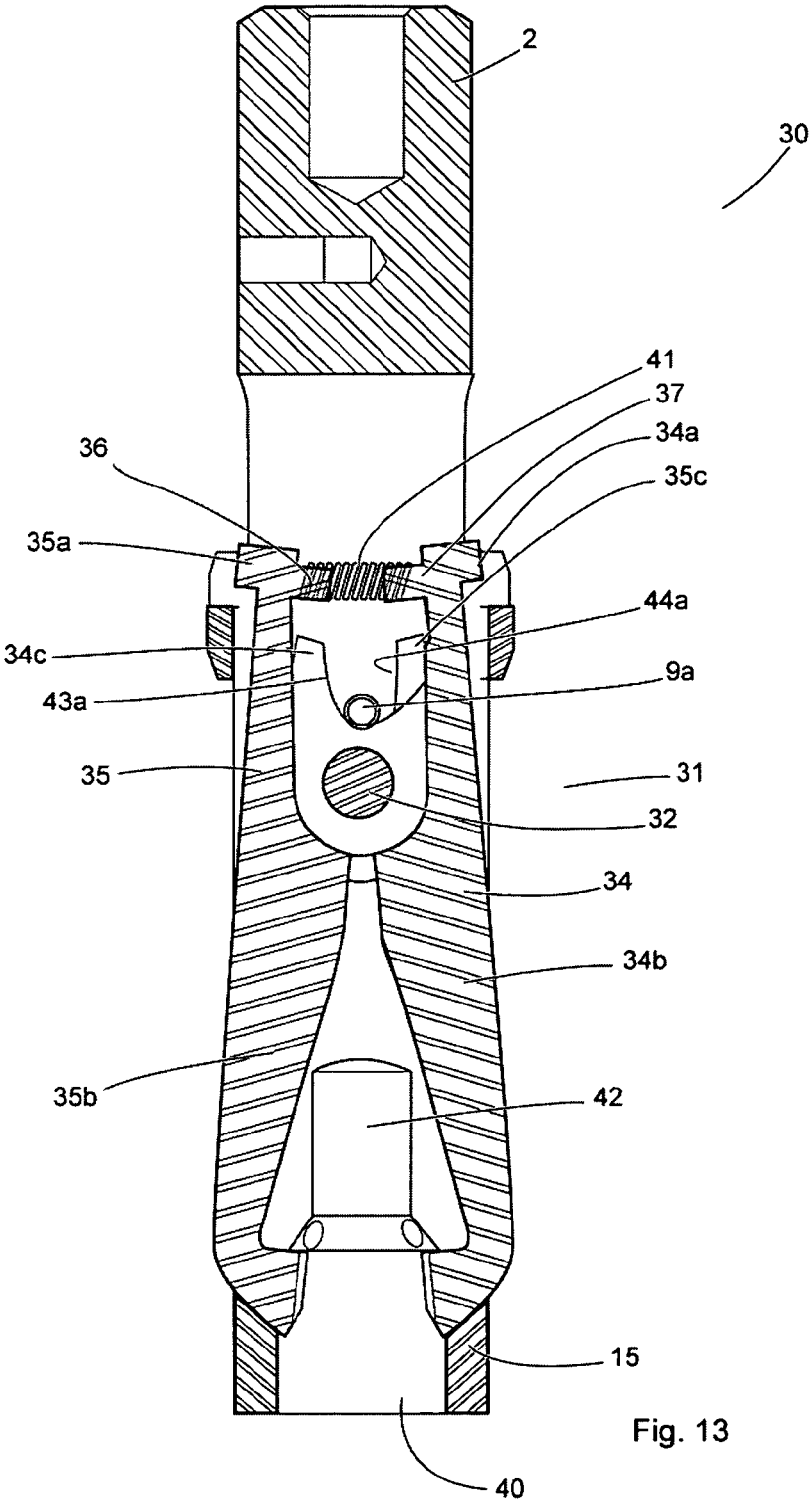
FIG. 13 is a cross section of the overshot in FIG. 10 in an open releasing position.

FIG. 13 is a cross section of an overshot arrangement according to the invention in a second (open) position, as described above. In this open position, the common pivot pin 32 is in its uppermost position in the slot.

Manually holding the scissor like mechanism 31 against the opening means 9 in the up/top position will force the lifting dogs 34*b*, 35*b* open and thus allowing the release of a spearhead 42.

In the overshot device in FIG. 10-13, the spring biasing means comprises a compression spring 41 attached between the two lever portions 34*a*, 35*a* and connected in a first 36 and a second connection point 37. The compression spring 41 is adapted to force the first scissor portion 34*c* and the second scissor portion 35*c* apart and consequently forcing the first 34*b* and the second lifting portion 35*b* towards each other to a closed gripping position.

As described above, manually holding the scissor like mechanism 31 against the opening pin 9 in the up/top position will compress the compression spring 41. This in turn causes the first scissor portion 34*c* and second scissor portion 35*c* to pivot apart and the first 34*b* and the second lifting portion 35*b* pivot apart.

Figure 11B:
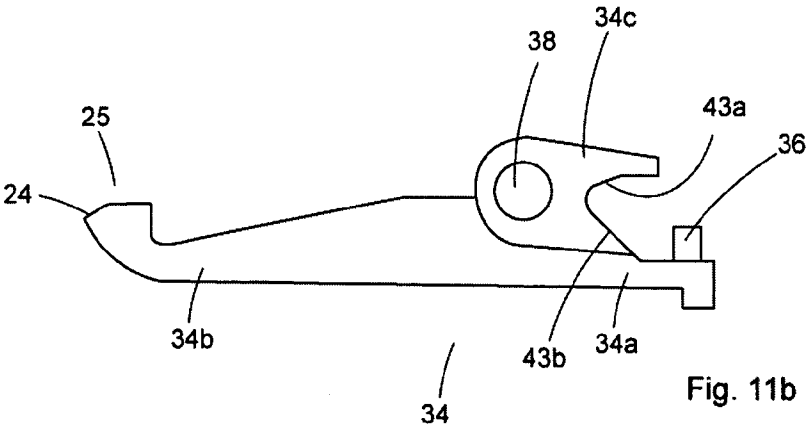

The first lifting dog 34 comprises a scissor portion 34*c* comprising a surface curvature 43 with a sliding surface 43*a* (FIG. 11*b*). The second lifting dog 35 comprises a scissor portion 35*c* comprises in the same way a surface curvature 44 comprising a sliding surface 44*a* (FIG. 12). The sliding surfaces 43*a*, 44*a* are arranged to follow/slide along the stationary opening pin 9*a* during the pivoting/pushing (FIG. 13) to an open position. Thus, the scissor like mechanism 31 is opened due to the forced pivoting of the two scissor portions 34*a*, 35*a* apart. Consequently, a spear head 41 received in the coaxial tubular opening 40 of the overshot is released when the pivot pin 32 is in its uppermost position, the second position as described above.

The method of operating an overshot will be explained in the following. The overshot 1, 30 is arranged hanging in a hoisting line (not shown), is lowered down in a drilled hole like a fishing system to grab a spearhead assembly connected to an inner tube. In this position, the scissor like mechanism 5, 31 is closed due to the spring's action 10*a*, 40. When the overshot 2 reaches the spearhead 4, the spearhead is free to pass into the coaxial tubular opening 3 of the overshot. The overshot is designed such that the weight of the elongated body 2*a*, i.e. the gravity forces keeps the elongated body hanging down while the spearhead 4, 41 pushes the scissor like mechanism 5 in the opposite direction, up in e.g. FIG. 3. The forced pushing upwards makes the opening means i.e. the stationary pin 9*a* forcing the lifting dogs 6, 7; 34, 35 to pivot into an open position where the spearhead 4, 41 is passing in between the lifting portions 6*b*, 7*b;* 34*b*, 35*b*. In this position the forced pushing upwards is ended, the scissor like mechanism is sliding/falling back downwards. During this sliding/falling back, the lifting dogs are automatically pivoting back into the closed position and the head 4 is automatically locked. The lifting portions 6*b*, 7*b;* 34*b*, 35*b* of the lifting dogs are designed with a curve wrap 24 (FIG. 1, 11*b*) around the neck to wrap around the neck of the spearhead, increasing the gripping of the spearhead. The lifting dogs also have curvature 25 (FIG. 1, 12) on the outside surface to interact with the matching curved features 15 within the overshot (FIG. 3, 12) to reduce wear and improve the distance required to lock the lifting dogs 6, 7; 34, 35 within the overshot head 1.

When the overshot and the back end or head assembly are connected for the core recovery, the overshot is gripping and the head 4, 42 is in this way/moment locked.

When it is time to release the inner-tube at the surface from the overshot, the operator has to push the spear head 4 inside the overshot 1 and maintain up the pivot pin 8 with the control lever 18 to up/top position. Alternatively, the tension of the lifting dogs is released on the spearhead to start with and then the operator has to maintain up the pivot pin 8 and push the control lever 18 to up/top position.

During the pushing movement, the scissor like mechanism 5 is pushed upwards with the pivot pin 8 sliding in the slot 12. The design of the overshot device 1 is based on the requirement that the mentioned manual pushing upwards of the pivot pin makes the lifting dogs 6, 7 pivoting. This is achieved due to the scissor like design with a common pivot pin 8 and of each lever portions 6*a*, 7*a* of the lifting dogs comprising a curvature surface 26*a*, 26*b* adapted to slide along the stationary pin 9*a* during the operators pushing of the control lever 18. When the manual pushing upwards overcomes the tension force of the tension spring 10*a*, the pushing and the design of the curvature surfaces 26*a*, 26*b* in combination with the stationary pin 9*a* forces the lever positions 6*a*, 7*a* to pivot apart. Consequently, the scissor like mechanism 5 is forced open and the spear head 4 is released.

Alternatively, during the pushing movement, the scissor like mechanism 31 is pushed upwards with the pivot pin 32 sliding in the slot (not shown). The design of the overshot device 30 is based on the requirement that the mentioned manual pushing upwards of the pivot pin makes the lifting dogs 34, 35 pivoting. This is achieved due to the scissor like design with a common pivot pin 32 and of each lever portions 34*a*, 35*a* of the lifting dogs comprising a curvature surface 43*a*, 44*a* adapted to slide along the stationary pin 9*a* during the operators pushing of the control lever 46 (FIG. 10). When the manual pushing upwards overcomes the compression force of the compression spring 41, the pushing and the design of the curvature surfaces 43*a*, 44*a* in combination with the stationary pin 9*a* forces the scissor portions 34*c*, 35*c* to pivot apart. Consequently, the scissor like mechanism 31 is forced open and the spear head 42 is released.

The first scissor portion 34*c* comprises an outer surface 44 (FIG. 11*a*), which faces towards the lever portion 35*a* of the second lifting dog 35 when comprised in the scissor like mechanism 31. In the same way, the second scissor portion 35*c* comprises an outer surface 45 (FIG. 12), which faces towards the lever portion 34*a* of the first lifting dog 34 when comprised in the scissor like mechanism 31.

When after pivoting, the scissor like mechanism 31 reaches its open position, the first outer surface 44 will be positioned adjacent the second lever portion 35*a* and the second outer surface 45 will be positioned adjacent the first lever portion 34*a*.

If the pivoting movement continues, the outer surfaces will get in contact with respective lever portion and stop the pivoting, as a secondarily purpose. In that way, the pivot movement is limited To limit the movement of the lifting dogs, the locking features of the head are designed to contain the lifting portion of the lifting dogs within the interior of the head throughout the travel of the lifting dogs.

The invention claimed is:

1. An overshot device, comprising:

a first part with an elongated body adapted to be connected to a hoisting line at a first end and with a tubular opening adapted to receive a spearhead in a second end, the elongated body comprising an central, axially extending slot, a second part with a scissor like mechanism comprising two lifting dogs and a common pivot pin about which the two lifting dogs are arranged to pivot, wherein the common pivot pin extends into the slot, a biasing unit operatively connecting the lifting dogs to each other, and an opener comprising an opening pin, wherein the scissor like mechanism is arranged with the common pivot pin sliding in the slot between a first end position where the biasing unit is arranged to close the lifting dogs such that the spearhead received in the tubular opening is locked and a second end position where the opener is arranged to force the lifting dogs open against a force of the biasing unit such that a spearhead received in the tubular opening is released.

2. The device according to claim 1, wherein the opening pin is a stationary opening pin attached to the elongated body.

3. The device according to claim 2, wherein the stationary opening pin is positioned axially above the slot, between the slot and the hoisting line connection end.

4. The device according to claim 3, wherein the stationary opening pin is arranged in parallel with the pivot pin.

5. The device according to claim 2, wherein the stationary opening pin is positioned axially below the slot, between the slot and the tubular opening end.

6. The device according to claim 1, wherein the opening pin is a sliding opening pin arranged sliding in the slot and connected to the pivot pin by a sliding bar.

7. The device according to claim 6, wherein the sliding opening pin is arranged in parallel with the pivot pin.

8. The device according to claim 1, wherein the body comprises a lock arranged to lock the lifting dogs inside the elongated body.

9. A method of operating an overshot device comprising a first part with an elongated body connected to a hoisting line at a first end and with a tubular opening adapted to receive a spearhead in a second end, the overshot device further comprising a second part with a scissor like mechanism comprising two lifting dogs and a common pivot pin, the overshot device further comprising a biasing unit operatively connecting the lifting dogs, the elongated body comprises an central, axially extending slot, and wherein the scissor like mechanism is arranged with the common pivot pin sliding in the slot, the method comprising:

manually operating the common pivot pin to slide in the slot from a first end position, where the biasing unit is arranged to pivot the lifting dogs to grip a spearhead received in the tubular opening to a second end position, and forcing the lifting dogs to pivot into a non-gripping position due to the sliding movement such that the spearhead is released when the pivot pin reaches the second position.

10. The method according to claim 9, wherein a lock locks the lifting portions of the lifting dogs within the interior of the elongated body.

11. The method according to claim 9, further comprising:

propelling the overshot through a drill string using fluid under pressure an underground application in conjunction with an underground adapter adapted with a propulsion seal.

* * * * *